US006666003B1

(12) United States Patent
Allais et al.

(10) Patent No.: US 6,666,003 B1
(45) Date of Patent: Dec. 23, 2003

(54) METHOD AND DEVICE FOR FILLING DRUMS CONTAINING DANGEROUS WASTE

(75) Inventors: Patrick Allais, Equeurdreville (FR); Jean-Claude Dumont, Tonneville (FR)

(73) Assignee: Compagnie Generale des Matieres Nucleaires, Velizy-Villacoublay (FR)

( * ) Notice: Subject to any disclaimer, the term of this patent is extended or adjusted under 35 U.S.C. 154(b) by 0 days.

(21) Appl. No.: 09/786,785

(22) PCT Filed: Sep. 15, 1999

(86) PCT No.: PCT/FR99/02190

§ 371 (c)(1),
(2), (4) Date: Jun. 18, 2001

(87) PCT Pub. No.: WO00/16340

PCT Pub. Date: Mar. 23, 2000

(30) Foreign Application Priority Data

Sep. 16, 1998 (FR) ..... 98 11562

(51) Int. Cl.[7] ..... G21F 9/36

(52) U.S. Cl. ..... 53/432; 53/381.2; 53/468; 53/510

(58) Field of Search ..... 53/468, 432, 510, 53/381.2; 588/900, 2, 3, 245, 252; 141/93

(56) References Cited

U.S. PATENT DOCUMENTS

| | | | | | |
|---|---|---|---|---|---|
| 2,930,170 | A | * | 3/1960 | Holsman et al. | 53/426 |
| 3,299,603 | A | * | 1/1967 | Shaw | 53/426 |
| 4,432,942 | A | | 2/1984 | Adachi et al. | |
| 4,439,403 | A | | 3/1984 | Brunner et al. | |
| 4,445,550 | A | * | 5/1984 | Davis et al. | 141/329 |
| 4,582,638 | A | * | 4/1986 | Homer et al. | 588/16 |
| 4,597,245 | A | * | 7/1986 | Parker | 53/510 |
| 4,673,814 | A | | 6/1987 | Schroeder et al. | |
| 4,717,510 | A | * | 1/1988 | James | 588/3 |
| 4,761,127 | A | * | 8/1988 | O'Brien et al. | 425/110 |
| 4,805,378 | A | * | 2/1989 | Anderson | 53/426 |
| 4,834,914 | A | * | 5/1989 | Jackson | 588/6 |
| 4,834,917 | A | | 5/1989 | Ramm et al. | |
| 5,140,165 | A | | 8/1992 | Kiuchi et al. | |
| 5,248,453 | A | | 9/1993 | Ramm | |
| 5,378,410 | A | * | 1/1995 | Erbse et al. | 588/16 |
| 5,549,586 | A | * | 8/1996 | Gunya et al. | 604/319 |
| 5,676,185 | A | * | 10/1997 | Starr et al. | 141/300 |
| 6,359,187 | B1 | * | 3/2002 | Lamoureux | 588/20 |
| 6,431,975 | B1 | * | 8/2002 | Ryan | 454/49 |

FOREIGN PATENT DOCUMENTS

| | | |
|---|---|---|
| EP | 0 327 271 | 8/1989 |
| GB | 1 594 839 | 8/1981 |
| JP | 59-220698 | 12/1984 |

OTHER PUBLICATIONS

Japanese Abstract for 59–220698; Database WPI; Derwent Publications Ltd., London, GB; XP002103265; Dec. 1984; 1 page.

* cited by examiner

*Primary Examiner*—Rinaldi I. Rada
*Assistant Examiner*—Brian Nash
(74) *Attorney, Agent, or Firm*—Pearne & Gordon LLP

(57) ABSTRACT

Dangerous wastes, such as very low level radioactive waste are processed and compacted under the form of flat cakes (12) stacked in metallic drums (10) closed by an intermediary lid (16) provided with a cap. A blocking material is then injected into the drum by an injection nozzle (42), after a toothed crown (38) surrounding this nozzle has perforated the cap. The toothed crown (38) is carried by a dynamic containment hood (28) in which there is also a circuit (44) for negative pressure application to the drum (10) and the hood. This circuit sucks out the contaminated air contained in the tank when it is perforated and during injection. The operation is thus carried out without risk of contaminating the workshop and the external surface of the drum.

17 Claims, 3 Drawing Sheets

METHOD AND DEVICE FOR FILLING DRUMS CONTAINING DANGEROUS WASTE

TECHNICAL FIELD

The invention relates to a process making it possible to ensure the filling of drums containing dangerous wastes, such as very low level radioactive waste, previously processed and compacted to form "flat cakes" piled on top of each other inside the drum.

Another object of the invention is an installation for operating this process.

STATE OF THE ART

In nuclear installations, low level technological wastes are first of all processed in cylindrical metallic containers. The volume of these containers is, for example, 120 litres.

The containers holding the wastes are then compacted using a press, to obtain "cakes" greatly reduced in volume, height-wise relative to the containers.

During a later stage, these cakes are piled in cylindrical metal drums. As a general rule, five cakes, for example, are piled in each of the drums.

During a following operation called "blocking" the drums are placed on a vibrating table and filled with a blocking material such as a cement plaster or grout.

When a drum has been filled with blocking material, it is then closed by means of a crimped lid.

Finally, when the blocking material is dry, the drums are transported to a long-term surface storage site.

More precisely, the invention concerns the blocking operation, during which the drums containing the cakes are filled with a blocking material.

At the time of this operation, which is carried out in a workshop, the contaminated air contained in the drum escapes into the workshop and tends, in particular, to contaminate the external wall of the drum as well as the close surroundings. In fact, a volume of contaminated air equivalent to that of the blocking material injected into the drum escapes from it to the outside.

In prior art, no known technical solution exists for this problem.

DESCRIPTION OF THE INVENTION

The object of the invention is precisely a process for filling a drum containing dangerous wastes, making it possible to avoid any dispersion of contamination into the atmosphere of the room, and in particular onto the external wall of the drum, due to the contaminated air ejected from the drum during the blocking operation.

According to the invention, this result is obtained by means of a process for filling drums containing dangerous wastes, characterised in that it comprises the following stages:

- assembly of an intermediary lid on a drum, said lid comprising an opening closed in a sealed fashion by a cap;
- perforation of the cap by a toothed crown carried by a containment hood overhanging an end of the drum closed by the intermediary lid;
- injection of a blocking material into the drum, by means of an injection tube located inside the toothed crown;
- negative pressure application to the drum and the containment hood, as soon as the drum is set in place and during perforation and injection.

In the process described above, the intermediary lid provided with its cap ensures the sealed containment of the drum before perforation of the cap. After perforation, dynamic containment is ensured by negative pressure application to the drum and containment hood. Thus, the contaminated air contained in the drum is sucked out as the drum is filled with the blocking material, without this air being dispersed into the atmosphere of the workshop. Thus one avoids in particular, any contamination of the external walls of the drum.

According to a preferred embodiment of the invention, the end of the filling of the drum by blocking material is detected, in such a way as to stop injection of this material.

Detection of the end of filling of the drum can in particular be ensured by at least one bubble tube opening into the interior of the toothed crown.

In this case, in order that the level of filling can be controlled with precision, advantageously the end of the bubble tube is positioned at a predetermined level below the cap, after perforation of the latter. To do this, one can in particular use a laser detector mounted on the containment hood and able to measure the distance between the latter and the intermediary lid.

Preferably, the cap is equipped with ballast means to ensure, through gravity, the evacuation into the drum of the disc cut out in the cap by the toothed crown, in order to avoid total or partial closing of the orifice of the injection tube through a suction effect on the cap.

The perforation of the cap can in particular be carried out by displacing the drum upwards relative to the fixed containment hood. Advantageously, lifting means such as a jack can be used for this. Preferably, these lifting means are associated with means capable of making the drum they support vibrate, during filling, so as to improve the penetration of the blocking material in the drum, around the radioactive waste.

As a variant, the perforation of the cap can also be obtained by displacing the toothed crown or the hood downwards.

In order to avoid in particular the blocking material setting before being injected into the drum, advantageously this material is made to circulate continuously in a closed circuit, during the period preceding this injection.

Moreover, after injection of the blocking material into the drum, it is preferable to carry out a cleaning of the means of injection, that is to say of the closed circuit and the nozzle through which the material is injected into the drum.

Finally, after injection of the blocking material into the drum, the latter is separated from the containment hood and an external lid is placed on the drum, above the intermediary lid. The drum then passes into a crimping machine which crimps the external lid. Then the drum is in a condition ready for storage, before being transported to a site prepared for very long-term storage.

Another object of the invention is an installation for filling drums containing dangerous wastes, characterised in that it comprises:

- an intermediary lid able to be mounted on a drum, said lid comprising an opening closed in a sealed fashion by a cap;
- a containment hood able to overhang an end of the drum closed by the intermediary lid, said hood having a toothed crown able to perforate the cap;
- means of injection of a blocking material, opening inside the toothed crown; and
- means of negative pressure application for the drum and the containment hood.

BRIEF DESCRIPTION OF THE FIGURES

A preferred embodiment of the invention is described below, as a non-limiting example, referring to the attached drawings, in which.

DETAILED DESCRIPTION OF A PREFERRED EMBODIMENT OF THE INVENTION

Figure 1:
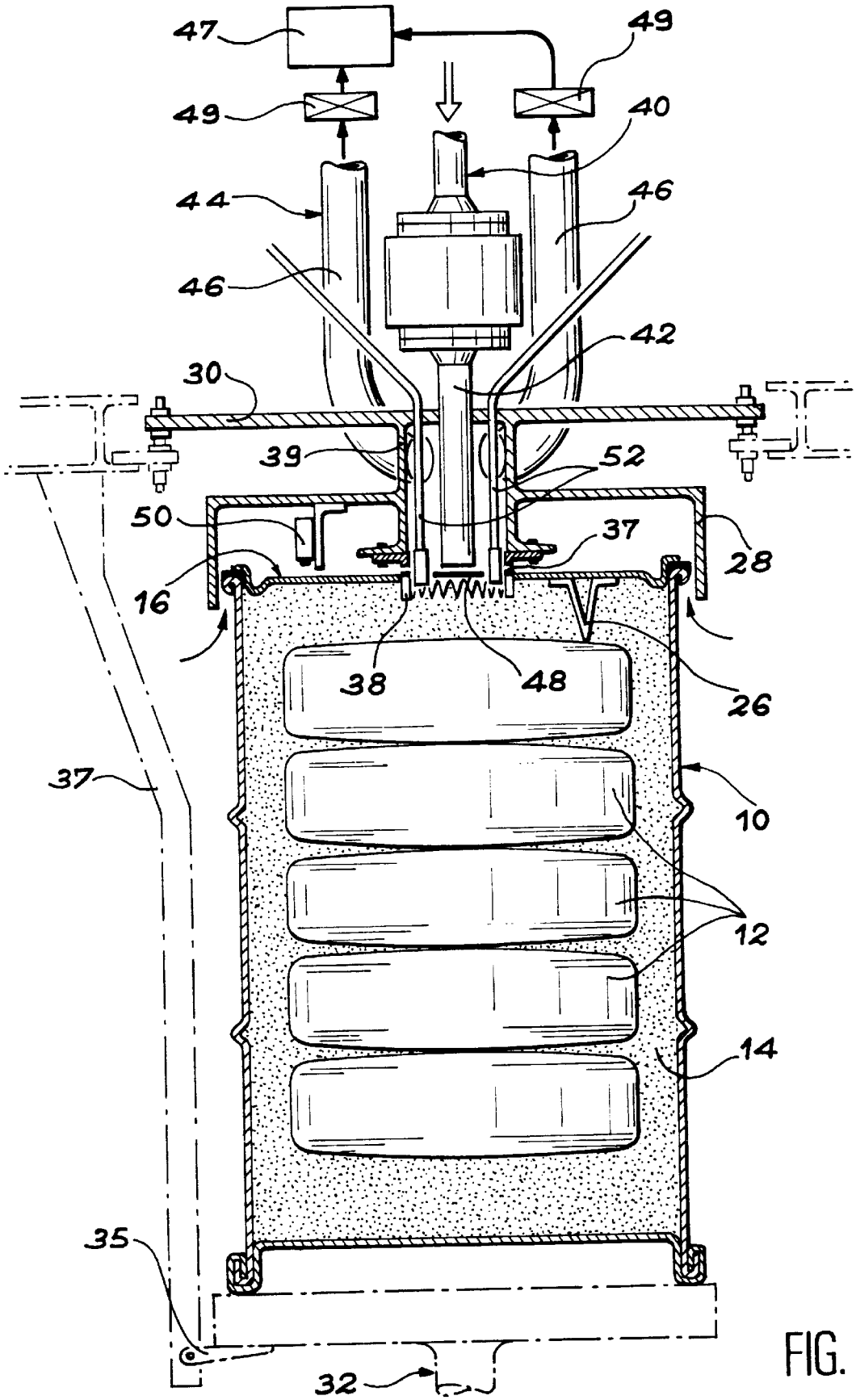
FIG. 1 is a vertical section illustrating the filling of a drum containing radioactive wastes by means of a filling installation according to the invention.

In FIG. 1, reference 10 refers to a cylindrical metallic drum in which nuclear waste of very low radioactivity is placed beforehand. More precisely, these nuclear wastes are in the form of flat cakes 12, piled one on top of the other inside the drum 10. Each of these flat cakes 12 is constituted of a cylindrical metallic packaging filled with nuclear waste of very low activity, then compacted inside a press.

As indicated above, the invention concerns a process and an installation making it possible to carry out a blocking operation, during which a blocking material 14 such as cement plaster is injected successively into each drum 10, to immobilise the flat cakes 12 there by filling as far as possible the free space inside the drum 10. According to the invention, the process and installation are designed in such a way that the blocking operation is carried out while avoiding any dispersion of the contaminated air initially contained in the drum 10 into the atmosphere of the processing workshop and in particular on the external wall of the drum.

The installation according to the invention comprises an intermediary lid 16, which is mounted on the open upper end of the drum 10 as soon as the cakes have been placed in it. The intermediary lid 16 is then crimped.

Figure 2:
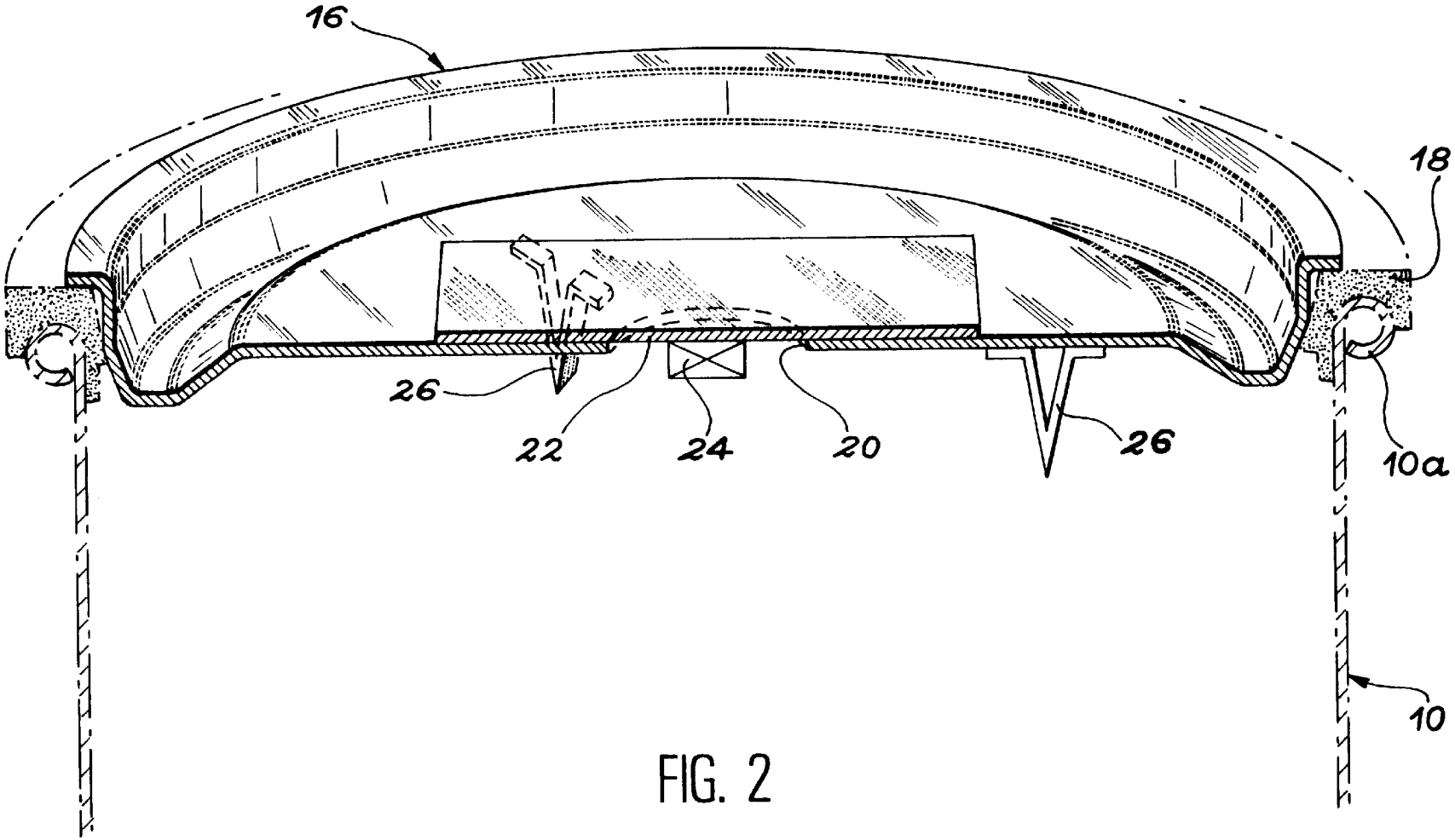
FIG. 2 is a view in perspective and cut-away, showing in more detail the intermediary lid placed on the drum, as well as its cap.

As shown more clearly in FIG. 2, the intermediary lid is fixed in a sealed fashion to the upper part of the drum 10. In order to do this, it can in particular be fitted into an annular sealing joint 18 which covers the curl 10a forming the upper end of the drum 10, and then crimped.

The intermediary lid 16, made out of sheet metal, comprises at its centre a circular opening 20. The diameter of this opening is, for example, 164 mm in the case of a drum 10 of 570 mm diameter.

The circular central opening 20 of the intermediary lid 16 is initially closed in a sealed fashion by a metallic cap 22, for example in aluminum, glued on the upper face or external to the intermediary lid 16. The metallic cap 22 is constituted of a temporary closing pellet for the drum. At its centre, on its lower surface turned towards the inside of the drum 10, it is provided with a ballast domino 24 constituting ballast means whose function will be made clear below. As a non-limiting example, the mass of the ballast domino 24 can be about 50 gm.

On its lower face turned towards the interior of the drum 10, the intermediary lid 16 comprises at least one anti-float organ such as three lugs 26 soldered on the lid 16 and arranged at 120° one after the other around a circle centered on the axis of the intermediary lid 16. As a non-limiting example, the circle around which the lugs 26 are arranged can have a diameter of 350 mm. The lugs 26 stick out downwards inside the drum 10, of a determined length, for example 45 mm. Thus they maintain a minimum free space of the same height between the intermediary lid 16 and the top of the pile of cakes 12 placed in the drum 10. This space favors later flow of the blocking material 14 when it is injected into the drum.

The installation according to the invention also comprises a dynamic containment hood 28 (FIG. 1) under which is placed the upper part of the drum 10 closed by the intermediary lid 16, when the blocking operation is carried out. In the embodiment represented, the dynamic containment hood 28 is fixed. More precisely, it is fixed under a horizontal partition 30 equipping the processing workshop.

The setting of the upper part of the drum 10 under the dynamic containment hood 28 is obtained by placing the drum 10 on the upper plate of a jack 32 comprising lifting means. When lifting of the drum 10 is completed, its upper end is received inside the dynamic containment hood 28, as illustrated in FIG. 1.

In order to improve filling of the drum 10 by the blocking material 14 during the blocking operation, means 34 (FIG. 3) able to make the drum 10 vibrate are associated with the jack 32. In other terms, the latter is a vibrating jack.

In FIG. 1, lines of dots and dashes represent diagrammatically an anti-fall system constituted of fingers 35 linked by arms 37 to the horizontal partition 30. When the drum 10 is in the upper position, the fingers 35 arrive under the upper plate of the jack and ensure that it is maintained in this position, even in the case of failure of the jack 32.

Figure 3:
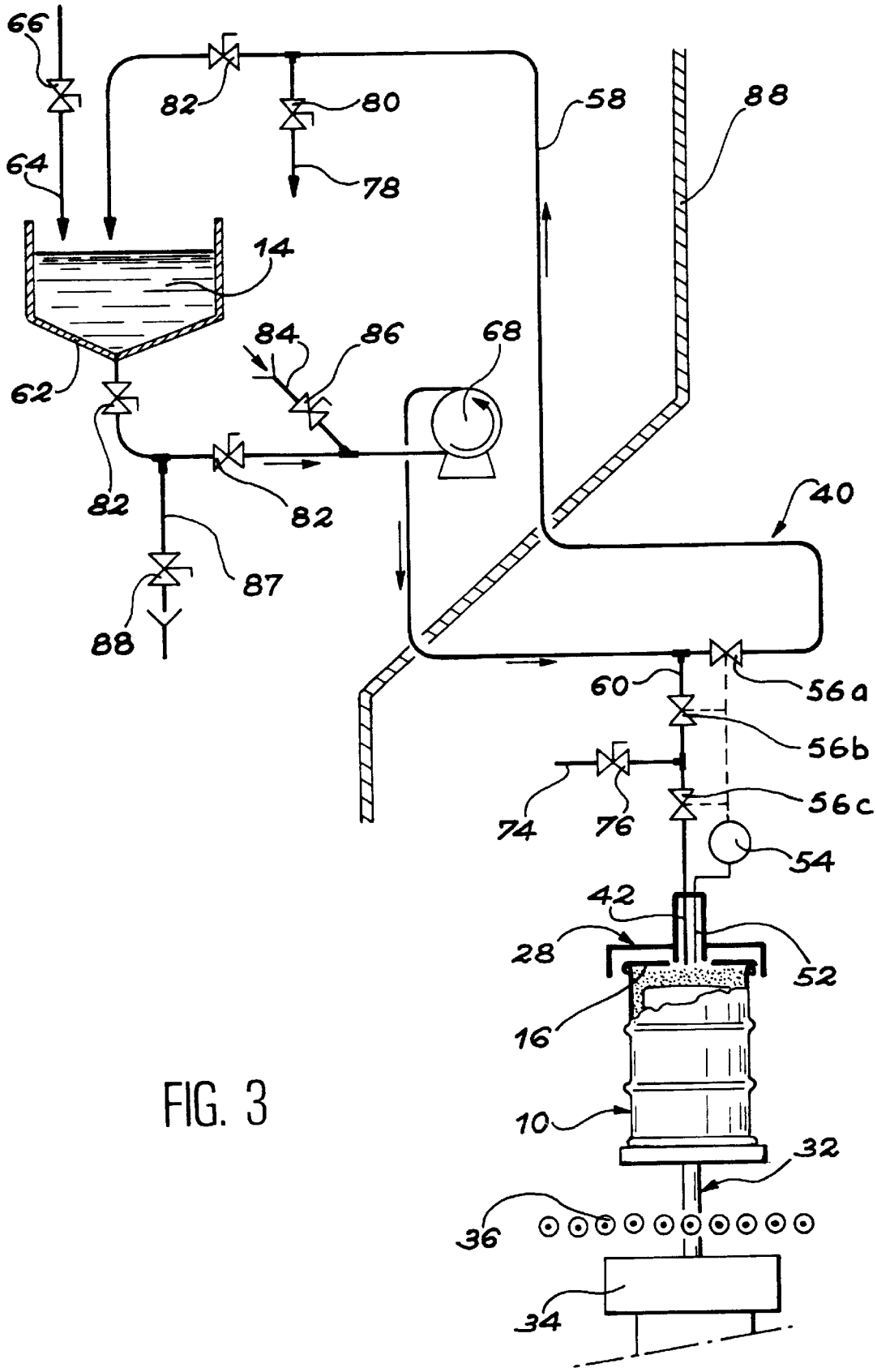
FIG. 3 shows diagrammatically the means of injection of the blocking material used in the filling installation according to the invention.

As shown diagrammatically in FIG. 3, the drums 10 are moved one after the other above the jack 32 by a conveyor belt 36, to be submitted to the blocking operation. They are then moved on from this post by the same conveyor belt 36.

According to the invention, the dynamic containment hood 28 supports in its centre the collar 39, terminated at its lower part by a toothed crown 38 (FIG. 1). This toothed crown 38 is placed along the axis of the opening 20 formed at the centre of the intermediary lid 16 and its diameter is slightly smaller than that of this opening. The toothed crown 38 is provided around the length of its boundary with pointed and long saw-teeth directed downwards. These saw-teeth ensure the perforation of the cap 22 at the end of the lifting of the drum 10 under the dynamic containment hood 28, just before the beginning of injection of the blocking material 14.

Holes 37 are pierced all around the cylindrical support of the toothed crown 38, at such a level that they are below the intermediary lid 16, at the end of the piercing operation of the cap 22. These holes 37 avoid negative pressure application to the cap 22 after piercing and allow good air circulation.

When perforation is carried out, the ballast domino 24 placed at the centre of the cap 22 drags downwards, by gravity, the disc cut out in the cap by the toothed crown 38. The ballast domino 24 ensures that the disc falls in the drum and thus prevents this disc remaining inside the toothed crown 38 and closing the piping opening inside the crown. It also avoids the risk of it floating on the surface of the blocking material 14.

The installation according to the invention also comprises means 40, for injecting the blocking material 14 in the drum 10. These means of injection 40, which will be described in more detail below with reference to FIG. 3, comprise in particular an injection nozzle 42 which opens inside the toothed crown 38, as shown in FIG. 1. The injection nozzle 42 is oriented downwards and is preferably arranged along the axis of the toothed crown. When the cap 22 has been perforated by the toothed crown 38, the operation of the means of injection 40 makes it possible to inject blocking material 14 directly inside the drum 10 without rupture of the containment of the latter.

The installation according to the invention also comprises means 44 of negative pressure application onto the drum 10 and the interior of the dynamic containment hood 28. These means for negative pressure application 44 comprise in particular one or several air suction tubes 46, which open inside the collar 39 carrying the toothed crown 38. The air suction tube or tubes 46 are linked to suction means 47 able to extract the contaminated air pushed out of the drum 10, while blocking material 14 is injected, still maintaining negative pressure in the drum and inside the dynamic containment hood 28, compared to the outside environment. As a non-limiting illustration, the depression produced by the negative pressure application means 44 is, for example, about 2660 Pa.

The negative pressure application means 44 also comprise very high efficiency filters 49 able to retain the totality of the contaminated dusts contained in the air sucked out.

Advantageously, the means of suction 47 are doubled, in order to avoid any loss of containment in the event of deterioration of the main suction system or a loss of electricity supply.

Advantageously and as shown schematically in FIG. 1, a deflector 48 is placed inside the toothed crown 38, immediately below the injection head 42, so as to direct the blocking material 14 towards the periphery of the drum 10. Thus any risk of clogging, even temporary, is avoided for the air suction tubes 46. In fact, in the absence of a deflector, a bank of blocking material could be formed on the top of the pile of cakes 12.

Outside the collar 39 carrying the toothed crown 38, the upper wall of the dynamic containment hood 28 supports a laser detector 50 directed towards the intermediary lid 16. The laser detector 50 makes it possible to measure the distance separating the containment hood 28 from the intermediary lid 16. Linked to a control circuit (not shown) of the lifting jack 32, the laser detector 50 thus forms means for positioning the lower end of at least one bubble tube 52 at a predetermined level below the cap 22, after perforation of the latter (preferably, two bubble tubes 52 are used, as shown in FIG. 1). In other terms, when the distance measured by the laser detector 50 reaches a predetermined value, the upward movement of the drum 10 assured by the lifting jack 32 is stopped. The lower ends of the bubble tubes 52 are then at a predetermined level below the intermediary lid 16. The control of this positioning makes it possible to pilot precisely the filling level of the drum 10 with the blocking material 14, by using the bubble tubes 52.

For this, the lower parts of the bubble tubes 52 (FIG. 1) are placed inside the collar 39 carrying the toothed crown 38. The level of the lower ends of the bubble tubes 52 is such that, when the lifting of the drum 10 has been stopped in response to the measurement made by the laser detector 50, these ends are situated at a level slightly lower than that of the intermediary lid 16. As an example, the lower ends of the bubble tubes 52 can be at 4 mm below the level of the intermediary lid 16. The bubble tubes 52 thus constitute means for detecting the filling of the drum 10. In other terms, when the bubble tubes 52 are closed by the blocking material 14 at the end of filling, one is sure that the drum is completely filled. The filling of the drum is thus stopped.

When two bubble tubes 52 are used as shown in FIG. 1, advantageously they are placed in positions diametrically opposite each other relative to the vertical axis of the dynamic containment hood 28. Thus they ensure redundancy of detection.

In FIG. 3, a diagram is shown of means of level detection 54 to which the bubble tubes 52 are connected. These means of level detection 54 pilot the automatic closing of two level-detection valves 56*a* and 56*b*, placed in a circuit for feeding the nozzle 42 with blocking material 14. This supply circuit constitutes, with the injection nozzle 42, the injections means 40. A third valve 56*c*, located immediately above the injection nozzle 42, serves as a safety valve and enables piloting of the rinsing of the supply circuit. It is controlled from the operations room, by an on-off control.

As shown in FIG. 3, the supply circuit for the nozzle 42 comprises a closed circuit 58 connected to the injection nozzle 42 by a pipe 60 in which the valves 56*b* and 56*c* are placed.

The closed circuit 58 comprises a hopper 62 for filling and storing the blocking material 14. The capacity of the hopper 62 is designed to allow at least one drum 10 to be filled. The hopper 62 is filled with the desired volume of blocking material, from a mixer (not shown), let in through a pipe 64 through a valve 66. The closed circuit 58 allows the blocking material 14 to circulate continuously in a loop, to avoid it all setting, to increase its lifetime and to limit the effects of clogging the tubing, until this material is injected into the drum 10. For this, it is equipped with pumping means such as a peristaltic pump 68. The valve 56*a* piloted by the level detection system 54 is placed in the closed circuit 58, immediately below the branch linking the circuit 58 to the injection nozzle 42 through the pipe 60.

A pipe 74, provided with a valve 76, links the water distribution network to the pipe 60 between the two valves 56*b* and 56*c* placed on it. This pipe 74 makes it possible, by injecting water under pressure, to carry out the rinsing of the central and lower parts of the injection nozzle 42 when the drum which has just been filled has been emptied. It is set in action before the following drum arrives underneath the dynamic containment hood 28. The recuperation of rinsing effluents is carried out by a retractable plate (not shown) which comes into place against the dynamic containment hood 28, in place of the drum. The effluents are then directed towards a specialised installation for treating polluted water.

Other valves 82 are set in different locations around the closed circuit 58. In addition, a pipeline 84 provided with a valve 86 opens into the circuit 58, near the suction of the pumping means 68. This pipeline makes it possible to ensure the cleaning of the whole circuit, in particular by introducing a foam ball, through the piping 84, thus ensuring evacuation of the residual blocking material through emptying tubing 87, provided with a stop valve 88. The final rinsing of the closed circuit is carried out by injecting clean water into the hopper 62 (with pumping means 68 in operation) and recuperating the effluents in the retractable plate then set in place under the hood 28.

Only a part of the closed circuit 58 is inside the processing workshop in which the filling of the drums 10 is carried out. A portion of the containment partition 88 defining this workshop is shown diagrammatically in FIG. 3. The part of the circuit 58 located outside the processing workshop includes in particular the hopper 62 and the pumping means 68.

Advantageously, the whole of the installation is piloted by automatic control-command means (not shown).

When a drum 10 is brought up to the filling post in which the blocking operation is carried out according to the invention, it contains cakes 12 and its upper end is closed in a sealed fashion by the intermediary crimped lid 16 whose central opening 20 is closed by the cap 22. As soon as the drum 10 is set on the lifting jack 32 by the conveyor belt 36, its horizontal displacement is stopped and the drum is lifted up to the position shown in FIG. 1. In this position, controlled by laser detectors 50, the cap 22 is perforated by the toothed crown 38. The disc cut out in the cap falls immediately onto the pile of cakes 12, by gravity, because of the mass of the ballast domino 24.

Despite this perforation, the containment of the drum 10 remains intact, until the end of filling, by the dynamic containment hood 28 under negative pressure application by means 44 for negative pressure application.

The injection of the filling material 14 into the drum then begins under the action of the pumping means 68, after opening valves 56*a* and 56*c* placed in the piping 60. Simultaneously, the drum is made to vibrate by means 34 for creating vibration, associated with the jack 32.

The injection of the filling material 14 continues until the bubble tubes 52 detect the arrival of the free level of the blocking material immediately next to the intermediary lid 16. The level detection means 54 then automatically close the valves 56*a* and 56*b* and the injection is stopped.

Next, the jack 32 is once again activated to re-lower the drum 10 onto the conveyor belt and to carry it to the following post where an external lid (not shown) is set in place. More precisely, the external lid is set on the drum above the intermediary lid 16 and crimped on the curl 10*a* of the drum.

The process and installation which have just been described make it possible to carry out the blocking operation while still ensuring complete control of containment. Any dispersion of contamination into the atmosphere of the workshop, and in particular any contamination of the external wall of the drum is thus avoided.

What is claimed is:

1. Process for filling drums containing dangerous waste, said process comprising the following stages:

assembly of an intermediary lid on a drum containing dangerous waste, said lid comprising an opening closed in a sealed fashion by a cap;

providing a containment hood overhanging one end of the drum closed by the intermediary lid, applying negative pressure to the drum and the containment hood until the end of the process;

perforation of the cap by a toothed crown carried by said containment hood;

injection of a blocking material into the drum, by means of an injection tube located inside the toothed crown.

2. Process according to claim 1, in which the end of filling the drum by the blocking material is detected and the injection is stopped.

3. Process according to claim 2, in which the end of filling the drum is detected by at least one bubble tube opening inside the toothed crown.

4. Process according to claim 3, in which the end of the bubble tube is positioned at a predetermined level below the cap, after perforation of the cap.

5. Process according to claim 1, in which the drum is made to vibrate during injection of the blocking material.

6. Process according to claim 1, in which, before injection of the blocking material, the material is made to circulate continuously in a closed circuit.

7. Process according to claim 1, in which, after injection of the blocking material into the drum, the drum is separated from the containment hood and an external lid is placed on the drum, on top of the intermediary lid.

8. Process for filling drums containing dangerous waste, said process comprising the following stages:

assembly of an intermediary lid on a drum, said lid comprising an opening closed in a sealed fashion by a cap;

perforation of the cap by a toothed crown carried by a containment hood overhanging one end of the drum closed by the intermediary lid;

injection of a blocking material into the drum, by means of an injection tube located inside the toothed crown;

negative pressure application to the drum and the containment hood, as soon as the drum is set in place and during perforation and injection;

in which the cap is equipped with ballast means ensuring evacuation into the drum, by gravity, of a disc cut out in the cap at the time of its perforation.

9. Process for filling drums containing dangerous waste, said process comprising the following stages:

assembly of an intermediary lid on a drum, said lid comprising an opening closed in a sealed fashion by a cap;

perforation of the cap by a toothed crown carried by a containment hood overhanging one end of the drum closed by the intermediary lid;

injection of a blocking material into the drum, by means of an injection tube located inside the toothed crown;

negative pressure application to the drum and the containment hood, as soon as the drum is set in place and during perforation and injection;

in which the cap is perforated by displacing the drum upwards, in relation to a fixed containment hood.

10. Process for filling drums containing dangerous waste, said process comprising the following stages:

assembly of an intermediary lid on a drum, said lid comprising an opening closed in a sealed fashion by a cap;

perforation of the cap by a toothed crown carried by a containment hood overhanging one end of the drum closed by the intermediary lid;

injection of a blocking material into the drum, by means of an injection tube located inside the toothed crown;

negative pressure application to the drum and the containment hood, as soon as the drum is set in place and during perforation and injection;

in which, after injection of the blocking material into the drum, cleaning of the means of injection is carried out.

11. Installation for filling drums containing dangerous waste, said installation comprising:

an intermediary lid able to be mounted on a drum, said lid comprising an opening closed in a sealed fashion by a cap;

a containment hood able to overhang an end of the drum closed by the intermediary lid, said hood having a toothed crown able to perforate the cap;

means of injection of a blocking material, opening inside the toothed crown; and means of negative pressure application for the drum and the containment hood;

means for detecting the end of filling the drum with the blocking material, in which the means for detecting the end of filling the drum comprise at least one bubble tube opening inside the toothed crown;

means for positioning the end of the bubble tube at a predetermined level below the cap, in which the means for positioning the end of the bubble tube comprise a laser detector mounted on the containment hood and able to measure the distance between the containment hood and the intermediary lid.

12. Installation for filling drums containing dangerous waste, said installation comprising:

an intermediary lid able to be mounted on a drum, said lid comprising an opening closed in a sealed fashion by a cap;

a containment hood able to overhang an end of the drum closed by the intermediary lid, said hood having a toothed crown able to perforate the cap;

means of injection of a blocking material, opening inside the toothed crown; and means of negative-pressure application for the drum and the containment hood;

in which the lid is provided with ballast means in a part able to be perforated by the toothed crown.

13. Installation for filling drums containing dangerous waste, said installation comprising:

an intermediary lid able to be mounted on a drum, said lid comprising an opening closed in a sealed fashion by a cap;

a containment hood able to overhang an end of the drum closed by the intermediary lid, said hood having a toothed crownable to perforate the cap;

means of injection of a blocking material, opening inside the toothed crown; and means of negative pressure application for the drum and the containment hood;

in which the intermediary lid comprises, on a face able to be turned towards the interior of the drum, at least one anti-float organ able to rest on the radioactive wastes around the opening, to provide a free space between these wastes and the intermediary lid.

14. Installation for filling drums containing dangerous waste, said installation comprising:

an intermediary lid able to be mounted on a drum, said lid comprising an opening closed in a sealed fashion by a cap;

a containment hood able to overhang an end of the drum closed by the intermediary lid, said hood having a toothed crown able to perforate the cap;

means of injection of a blocking material, opening inside the toothed crown; and means of negative pressure application for the drum and the containment hood;

in which the means of injection of the blocking material comprise a closed circuit linked to the injection head of said material, opening inside the toothed crown.

15. Installation according to claim 14, in which a deflector is placed beneath the injection head, so as to direct the blocking material towards a peripheral region of the drum.

16. Installation according to claim 14, in which the closed circuit comprises:

a hopper for filling and storing the blocking material; and pumping means able to make the blocking material circulate from the hopper to the injection head and continuously in the closed circuit.

17. Installation according to claim 16, in which the closed circuit comprises in addition means for cleaning said circuit and the injection head.

* * * * *